US005531039A

United States Patent [19]

Gore

[11] Patent Number: 5,531,039

[45] Date of Patent: Jul. 2, 1996

[54] BASE FOR MOUNTING A TELESCOPIC SIGHT ON A GUN

[76] Inventor: Thomas D. Gore, 227 Coronation Ct., Canton, Mich. 48188

[21] Appl. No.: 401,240

[22] Filed: Mar. 9, 1995

[51] Int. Cl.[6] ..... F41G 1/387

[52] U.S. Cl. ..... 42/101; 33/245

[58] Field of Search ..... 42/101, 103; 33/245, 33/247, 248, 254, 257, 258, 259

[56] References Cited

U.S. PATENT DOCUMENTS

| | | | |
|---|---|---|---|
| 2,653,386 | 9/1953 | Winton | 33/248 |
| 3,555,687 | 1/1971 | Joseph | 33/245 |
| 4,779,370 | 10/1988 | Cormack | 42/101 |

FOREIGN PATENT DOCUMENTS

| | | | |
|---|---|---|---|
| 2500615 | 8/1982 | France | 42/101 |
| 401410 | 11/1945 | Italy | 42/103 |

*Primary Examiner*—Stephen M. Johnson
*Attorney, Agent, or Firm*—Charles W. Chandler

[57] ABSTRACT

A base for mounting an elongated telescopic sight on a gun which experiences a sudden reaction when a projectile is discharged from the gun. The gun has a pair of resilient leaf elements each supporting a sight mount to reduce the reactionary motion experienced by the sight.

13 Claims, 3 Drawing Sheets

BASE FOR MOUNTING A TELESCOPIC SIGHT ON A GUN

BACKGROUND OF THE INVENTION

This invention is related to a telescopic sight-supporting base for absorbing the sudden reactionary forces experienced by a gun such as a rifle, pistol or an air gun, when a projectile is discharged from the weapon. The base has a pair of cantilever-supported resilient leaf elements that support the scope mounts in such a manner as to absorb a sufficient amount of the shock to protect the telescopic sight components.

Most firearms have an elongated dove tail along the top of the firearm adapted to receive a pair of scope mounts which are clamped along the firearm a few inches apart. The scope mounts have a groove which is mounted on and then clamped to the dove, tail. The upper end of each mount has a clamping cap which embraces the sight. Thus, the sight becomes securely attached to the gun.

Many weapons such as a rifle experience a sudden reactionary force when a projectile is discharged from the weapon. An air gun experiences a double reaction. The sight mounted on the weapon experiences the same reaction. Telescopic sights usually have delicate cross hairs. The reactionary force is so severe that the cross hairs become separated, making the sight useless.

One prior art approach is to mount the sight on the firearm using rubber grommets to partially absorb the shock. In general, these have not been satisfactory.

SUMMARY OF THE INVENTION

The broad purpose of the present invention is to provide a shock-absorbing base between the scope mounts and the gun.

For illustrative purposes, the gun is an air gun, however, the invention is equally applicable to a firearm, such as a rifle. The base is aluminum and has a lower face with a groove adapted to engage the dove tail on the gun so that the base becomes securely attached to the gun. The upper face of the base has an elongated dove tail very similar to that carried on the gun. The two scope mounts are then clamped on opposite ends of the base.

The base is mounted parallel to the axis of the projectile discharged from the, weapon. The ends of the base have a pair of horizontal slots that form a cantilever, resilient leaf element under each scope mount. The two scope mounts, the sight and the leaf elements move in the nature of a spring with respect to the remainder of the, base attached to the air gun when the gun is fired.

Preferably each leaf element has a fixed end forming an integral part of the body of the base. The fixed end is relatively wide at the root of the leaf element and then gradually decreases in cross section towards the free end. This arrangement prevents the leaf element from forming a stress concentration at the fixed end which may act as a hinge tending to fracture in response to the abrupt reactionary forces.

The invention is applicable to either a base having either a single leaf element or a pair of leaf elements. In each case, the leaf element bends in a direction transverse to the projectile axis of the weapon.

In another embodiment, the leaf element is a separate component, attached by screws to the base.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
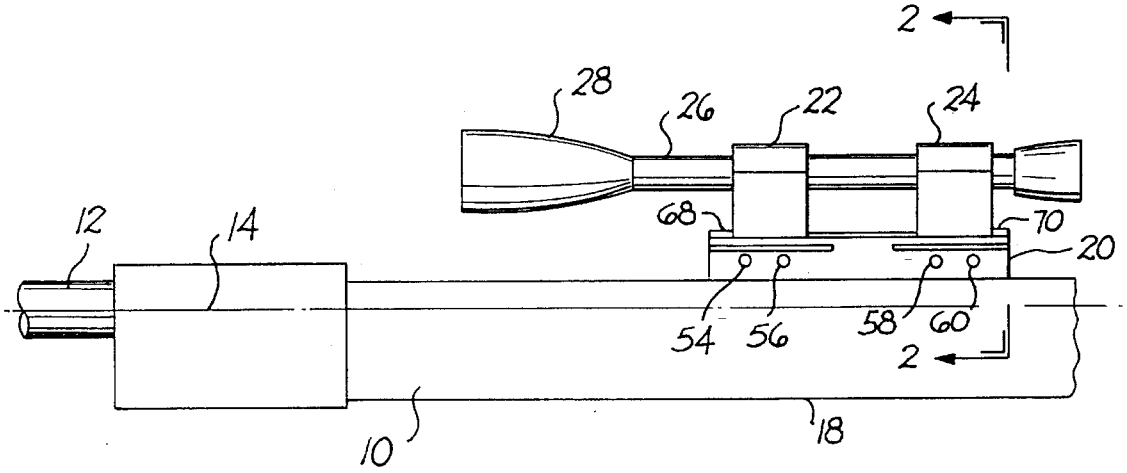
FIG. 1 is a fragmentary view of an air gun, with a shock absorbing base illustrating the invention supporting a telescopic sight.
Figure 2:
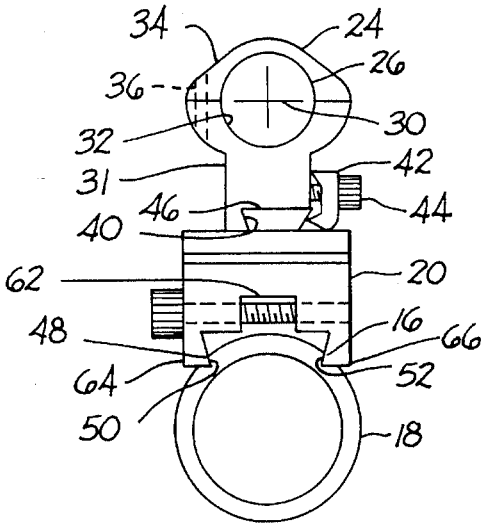
FIG. 2 is an enlarged view generally as seen along lines 2—2 of FIG. 1.

Referring to the drawings, an air gun 10 is illustrated in FIG. 1. Air gun 10 is an air rifle adapted to discharge a projectile, not shown, through a barrel 12 along a projectile axis of motion 14. When the projectile is fired in the manner well known to those skilled in the art, the air gun experiences an abrupt sudden reactionary force in a direction generally transverse to axis 14. Air gun 10 has the customary dove tail 16 running along the top of a tubular member 18, normally used to clamp a pair of scope mounts.

A base 20 illustrating the invention, supports a pair of conventional scope mounts 22 and 24 which in turn support a conventional telescopic sight 26. Sight 26 may be a Bushnell Sport View sight which weighs about 13 ounces and is about 12"in length. The sight has a wide forward end 28. A pair of cross hairs 30 are mounted in the sight so that the viewer can adjust the firearm according to the image of a target (not shown) in the manner well known to those skilled in the art.

Each of the scope mounts has a base 31 with a somewhat cylindrical seat 32. The sight is mounted on cylindrical seat 32. A clamping cap 34 is mounted on top of the base and held in position by threaded fastener means 36.

The base of the sight mount has a downward and inwardly turned lip 40. Clamping member 42 is connected by a pair of threaded fasteners 44 to form a complementary grooved structure which clamps on opposite sides of a dove tail 46 on the upper face of base 20. The dove tail is similar to that on top of the air gun and runs the full length of the base. The two sight mounts are connected to the sight and securely attached to the upper face of the base.

The lower face of base 20 has a longitudinally running groove 48 with a pair of inwardly facing shoulders 50 and 52 which are slideably engageable with the sides of dove tail 16 of the firearm. Base 20 is slideably mounted on the firearm by a longitudinal motion, and then clamped in position by four transversely mounted, longitudinally spaced threaded fasteners 54, 56, 58 and 60. Groove 48 includes a slot 62 which forms the lower portion of the base into a pair of laterally moveable legs 64 and 66. Tightening the threaded fasteners causes the legs to firmly clamp dove tail 16 between the legs.

Figure 3:
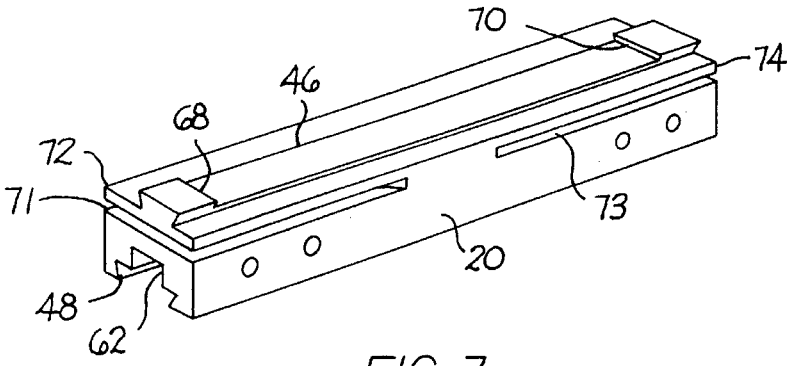
FIG. 3 is a perspective view of the base separated from the scope mounts and weapon.

FIG. 3 illustrates base 20 removed from both the air gun and the two scope mounts. For illustrative purposes, base 20 is formed of an aluminum alloy, or a suitable non-metallic composite, and is about 4" in length, and ⅞" wide. The base is mounted parallel to projectile axis of motion 14.

The ends of dove tail 46 have a pair of raised shoulders 68 and 70. Each scope mount is seated against the shoulder at its respective end of the base. Each shoulder locates its respective scope mount and prevents the scope mount from being longitudinally moved along the base when the projectile is fired. The shoulders eliminate the use of the pin that is commonly received in an opening in some firearms for locating the scope mount.

The left end of the base, as viewed in FIG. 3, has a slot 71 extending the full width of the base and about 1⅝" from the end of the base. The slot is about ⅜" wide and form a resilient leaf 72 about 7/32" thick. The opposite end of the base has a similar slot 73 forming a second resilient leaf 74. Scope mount 22 is clamped on leaf 72, while scope mount 24 is clamped on leaf 74.

Figure 5:
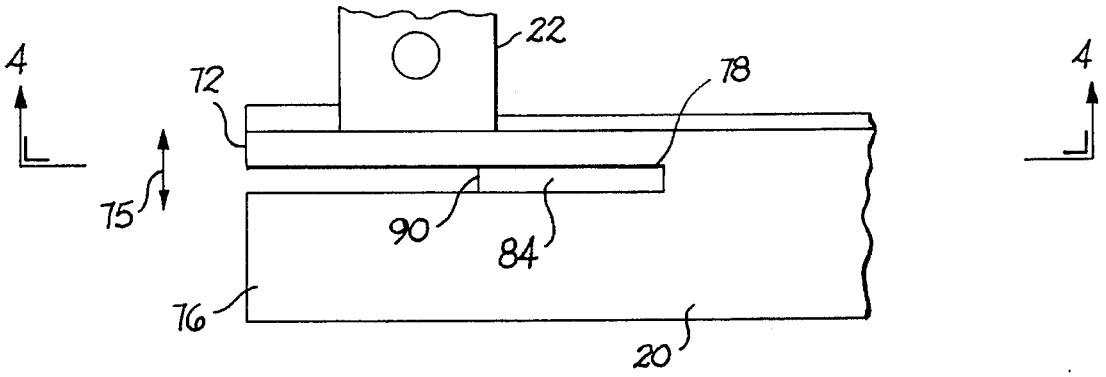
FIG. 5 is an enlarged elevational fragmentary view of a scope mount mounted on a leaf element.

Referring to FIG. 5, leaf 72 is moveable in the direction of arrows 75, that is transverse to the projectile axis of motion, with respect to the bottom part 76 of the base which is firmly clamped to the air gun. Thus, each leaf acts like a spring. Each leaf has a fixed end 78 forming an integral part of the base.

Figure 4:
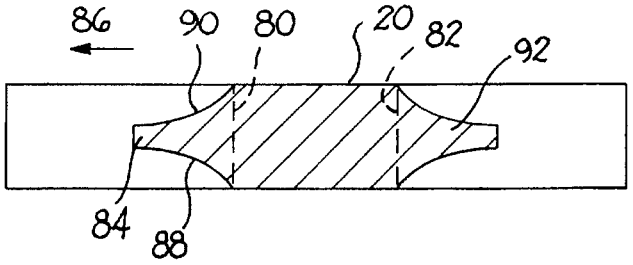
FIG. 4 is an enlarged plan view of the base with the leaf elements removed.

FIG. 4 shows a view of the base generally along lines 4—4 of FIG. 5, that is with the two leafs removed. Dotted line 80 illustrates the location of fixed end 78 of leaf 72 while dotted line 82 illustrates the fixed end of the second leaf.

Each leaf is mounted in a cantilever manner on the base, however, the fixed end of each leaf, for example leaf 72, is attached by a section of metal 84 which extends the full width of the fixed end of the leaf and then is gradually reduced in cross section as it progresses in the direction of arrow 86 toward the free end. The length of section 84 is about ¾". It is formed by a tool that forms a pair of curved walls 88 and 90, however, it can take other configurations as long as the fixed end 78 of the leaf has a cross section that narrows toward the free outer end of the leaf.

Leaf 74 has a similarly-shaped fixed end connection 92 so that it functions in a resilient manner as does leaf 72.

Section 84 prevents the fixed end of the leaf from moving as a hinge as it would if the slot were cut in a linear transverse line at 80 and 82, creating a high stress area. Sections 84 and 92 cause the leaves to somewhat bend as they vibrate with respect to the body of the base.

Referring to FIG. 5, preferably each scope mount, such as mount 22, is mounted on its respective leaf so that the major portion of the scope mount is over the free end of the leaf, however, it slightly overlaps the outer edge at 90 of the connection between the leaf and the lower portion of the base. Each scope mount can be adjusted along its respective leave to accommodate the length and weight of the sight, and to adjust the rebound motion of the scope mounts.

Figure 6:
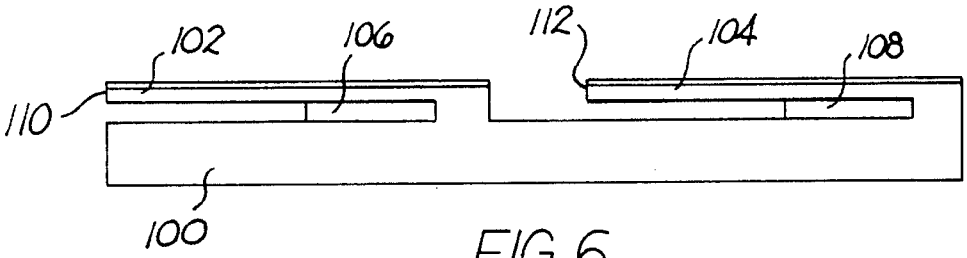
FIG. 6 is an elevational view of another embodiment of the invention.

FIG. 6 illustrates an alternative base 100 having a pair of leaves 102 and 104, each connected at their respective fixed ends by somewhat tapered connections 106 and 108 between each leaf and the body of the base. In this case the leaves have free ends 110 and 112, respectively, which are moveable in a direction transverse to the longitudinal axis of the base in a spring-like manner. The scope mounts are again also clamped on top of each leaf.

Figure 7:
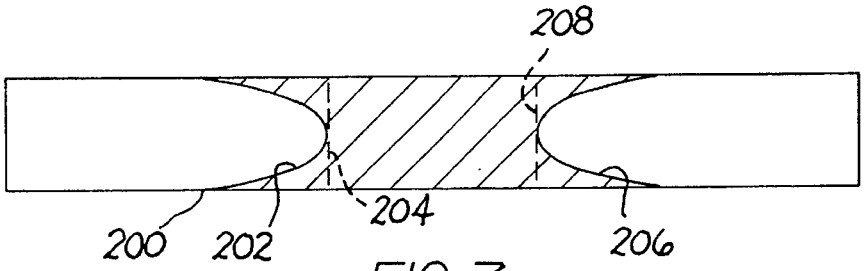
FIG. 7 shows a plan sectional illustration of another embodiment of the invention.

FIG. 7 illustrates still another embodiment 200 which is essentially identical to base 20 but in which the fixed end of the left leaf, not shown, is attached to the base by concave sections 202 which extend along an imaginary line 204. Similarly, the fixed end of the other leaf, not shown, is integrally connected to the body of the base by a concave area 206 which extends along an imaginary line 208. In both cases, the concave sections provide an integral connection that is widest at the fixed end of the leaf at 204 or 206, as the case may be, and then diminishes in cross section toward the free end of each leaf to reduce any stress point at the fixed end of the leaf.

In use, the base is slid on the end of the integral dove tail of the gun. Fasteners 54, 56, 58 and 60 are employed to clamp the base onto the dove tail. The two scope mounts 22 and 24 then are clamped on dove tail 46 extending along the top face of the base. In this arrangement, although the lower portion of the base is rigidly attached to the firearm so that it reacts with the firearm, the sight and the two mounts are moveable with their respective resilient leaves in a direction transverse to the motion of the projectile. Each leaf functions as a shock absorber, preventing the sight and in particular the cross hairs from experiencing the full impact of the forces discharging the projectile.

Figure 8:
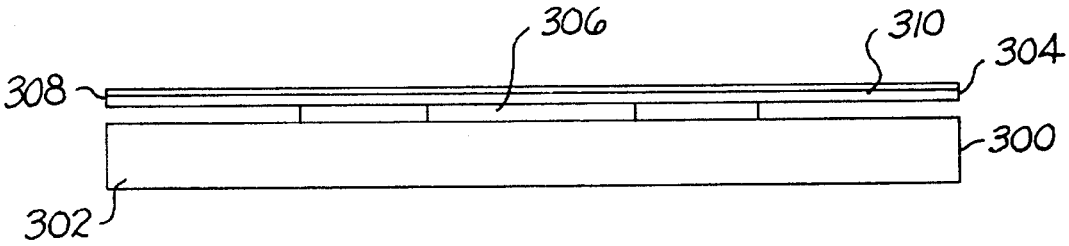
FIG. 8 is a side elevational view of a multi-component form of the invention.
Figure 9:
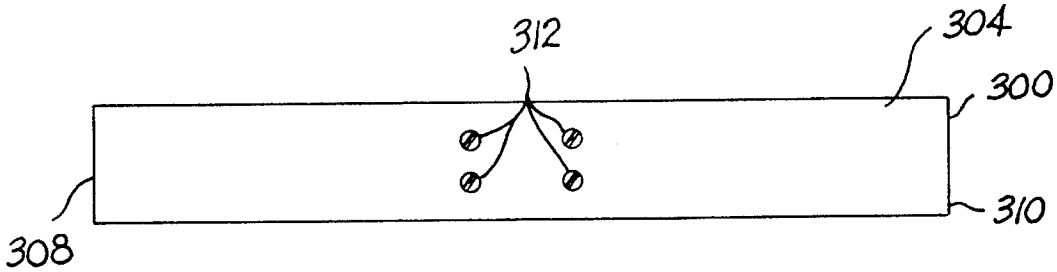
FIG. 9 is a plan view of the mount of FIG. 8.

FIGS. 8 and 9 illustrate another embodiment of the invention, which unlike the embodiments of FIGS. 1–7, is a multi-component mount 300. Mount 300 comprises an elongated body 302 having the same width and length as the embodiment of FIG. 3, preferably formed of an aluminum alloy. A one-piece leaf member 304 is mounted on a central support element 306 which has the same plan configuration as the central support of FIG. 4. Support element 306 is so mounted under the leaf member as to form a cantilever leaf element 308 at one end of the body for supporting one scope mount, and a second cantilever leaf end 310 at the opposite end of the body for supporting a second scope mount. Preferably leaf member is attached to the central support element by a suitable epoxy adhesive. Central support element 306 is also attached to the body by a suitable epoxy adhesive. The three components are further connected together by four fastener means 312, as illustrated in FIG. 9. The central support element is sandwiched between the leaf member and the body and may be of a rubber-like material. Further the leaf member may be formed of a non-metallic plastic such as a composite material or an aluminum alloy.

Having described my invention, I claim:

1. A base for mounting a telescopic sight on a device having a barrel which discharges a projectile along an axis of motion accompanied by an abrupt reactionary motion, comprising:

an elongated body and means for mounting the body on the device;

an elongated resilient leaf element having a first end connected in a cantilever manner to the body, and a second end which is moveable toward or away from the axis of motion of the projectile, the leaf element being supported parallel to the axis of motion of the projectile, the connection between the first end of the leaf element and the body comprising structure between the first end of the leaf element and the body having a decreasing cross sectional area from said first end partially toward the send end; and means for mounting a telescopic sight mount on the leaf element, whereby when the base and a telescopic sight mount are mounted on a device having a barrel which discharges a projectile along an axis of motion accompanied by an abrupt reactionary motion, the sight mount and the leaf element are moveable as a unit with respect to the body in a transverse direction with respect to axis of motion of the projectile in response to said reactionary motion caused by the; discharge of the projectile.

2. A base as defined in Claim 1, in which the body is formed of a metal.

3. A base as defined in Claim 1, in which the body is supported on the device in a position generally parallel to the axis of the projectile motion, and the leaf element is supported parallel to the longitudinal axis of the body, and has a free end adjacent one end of the body.

4. A base as defined in Claim 1, in which the leaf element forms an integral part of the body.

5. A base as defined in Claim 1, in which the leaf element is attached to the elongated body.

6. A base as defined in Claim 1, in which the leaf element has a dove tail having side edges adapted to be clamped by said telescope sight mount.

7. A base as defined in Claim 1, in which the first mentioned leaf element has a free end adjacent one end of the body, and including a second leaf element mounted adjacent the opposite end of the body, the second leaf element having one end attached to the body in a cantilever manner such that the opposite end of the second leaf is moveable in a direction generally transverse to the axis of the motion of the projectile.

8. A base as defined in Claim 1, in which the first end of the leaf element is attached to one end of the body such that the second end of the leaf element is resiliently moveable with respect to the body in a direction transverse to the projectile axis of motion.

9. A base as defined in Claim 1, in which the leaf element has a shoulder for engaging said telescopic sight mount to prevent movement of the telescopic sight mount in a longitudinal direction with respect to the body.

10. The combination comprising:

a gun which discharges a projectile along an axis of motion accompanied by an abrupt reacting motion;

a telescopic sight;

a pair of spaced scope mounts connected to the telescopic sight;

a base for mounting the telescopic sight and the scope mounts on the gun comprising:

an elongated body and means for mounting the body on the gun;

an elongated resilient leaf element having a fixed first end connected in a cantilever manner to the body, and second end which is moveable toward or away from the axis of motion of the projectile, the leaf element being supported parallel to the axis of motion of the projectile, the connection between the fixed end of the leaf element and the body comprising structure between the fixed end of the leaf element and the body having a decreasing sectional area from said fixed end toward said second end and extending only partially from the fixed end toward the second end; and means for clamping the scope mount on the leaf element, whereby the scope mount and the leaf element are moveable as a unit with respect to the body in a transverse direction with respect to the axis of motion of the projectile in response to the reactionary motion caused by the discharge of the projectile.

11. A base for mounting a telescopic sight on a device having a barrel which discharges a projectile along an axis of motion accompanied by an abrupt reactionary motion, comprising:

an elongated body and means for mounting the body on the device;

an elongated resilient first leaf element having a first end connected in a cantilever manner to the body, and a free second end moveable toward or away from the axis of motion of the projectile, the first leaf element being supported parallel to the axis of motion of the projectile;

a second leaf element mounted adjacent the opposite end of the body, the second leaf element having one end attached to the body in a cantilever manner such that the opposite end of the second leaf element is moveable in a direction generally transverse to the axis of the motion of the projectile;

the connection between the first end of the first leaf and the body comprising structure between the first end of the first leaf element and the body having a decreasing cross sectional area extending from said first end partially toward the second end; and means for mounting a telescopic sight mount on the leaf element, whereby when the base and a telescopic sight mount are mounted on a device having a barrel which discharges a projectile along an axis of motion accompanied by an abrupt reactionary motion, the sight mount and the leaf element are moveable as a unit with respect to the body in a transverse direction with respect to axis of motion of the projectile in response to said reactionary motion caused by the discharge of the projectile.

12. A mechanism for mounting a telescopic sight on a firearm, wherein the telescopic sight has a cross hair system subject to destruction from shock forces associated with firing of the firearm, said mechanism comprising:

an elongated base and means for attaching the base to the firearm;

a first elongated resilient leaf element having a first end connected to said base, and a second free end spaced from the base in cantilever fashion, whereby said first leaf element is enabled to vibrate in response to a shock force on the base;

a second elongated resilient leaf element having a first end connected to said base, and a second free end spaced from the base in cantilever fashion, whereby said second leaf element is enabled to vibrate in response to a shock force on the base;

a first attachment means for attaching the telescopic sight to the free end of said first leaf element; and a second attachment means for attaching the telescopic sight to the free end of said second leaf element.

13. A mechanism for mounting a telescopic sight on an air gun, wherein the telescopic sight has a cross hair system subject to destruction from shock forces associated with firing of the air gun; said mechanism comprising:

an elongated base and means for attaching the base to the air gun;

a first elongated resilient leaf element having a first end connected to said base, and a second free end spaced from the base in cantilever fashion, whereby said first leaf element is enabled to vibrate in response to a shock force on the base;

a second elongated resilient leaf element having a first end connected to said base, and a second free end spaced from the base in cantilever fashion, whereby said second leaf element is enabled to vibrate in response to a shock force on the base;

a first attachment means for attaching the telescopic sight to the free end of said first leaf element; and a second attachment means for attaching the telescopic sight to the free end of said second leaf element.

* * * * *